United States Patent [19]

Narusch, Jr. et al.

[11] Patent Number: 4,698,269

[45] Date of Patent: Oct. 6, 1987

[54] SINTERED, CORROSION-RESISTANT POWDERED METAL PRODUCT AND ITS MANUFACTURE

[76] Inventors: Michael J. Narusch, Jr., 12885 Greenbrier Dr., Chardon, Ohio 44024; Stanley G. LeBail, 24 Dorchester Rd., Painesville Township, Lake County, Ohio 44077

[21] Appl. No.: 861,004

[22] Filed: May 8, 1986

[51] Int. Cl.[4] ..... B22F 3/00

[52] U.S. Cl. ..... 428/552; 419/27; 428/403; 428/469; 428/550; 428/570; 148/6.15 R; 148/6.16; 148/6.2; 427/419.1

[58] Field of Search ..... 419/27; 428/403, 469, 428/550, 552, 570; 148/6.15 R, 6.16, 6.2; 427/419.1

[56] References Cited

U.S. PATENT DOCUMENTS

| | | | |
|---|---|---|---|
| 3,007,822 | 11/1961 | Kaiser et al. | 148/126 |
| 3,382,081 | 5/1968 | Cutter et al. | 106/14 |
| 3,437,531 | 4/1969 | Svadlenak | 148/6.2 |
| 3,671,331 | 6/1972 | Malkin et al. | 148/6.2 |
| 3,687,738 | 8/1972 | Malkin | 148/6.2 |
| 3,907,608 | 9/1975 | Barrett et al. | 148/6.2 |
| 4,000,982 | 1/1977 | Ueda | 29/182.3 |
| 4,008,101 | 2/1977 | Rowe et al. | 148/6.15 R |
| 4,014,802 | 3/1977 | Seino et al. | 252/12.2 |
| 4,029,523 | 6/1977 | Rowe et al. | 148/6.17 |
| 4,334,936 | 6/1982 | Goolkate | 148/6.15 R |
| 4,347,083 | 8/1982 | Sara | 419/17 |
| 4,365,003 | 12/1982 | Danforth et al. | 428/552 |
| 4,402,744 | 9/1983 | Sara | 75/239 |
| 4,447,273 | 5/1984 | Mueller et al. | 148/6.15 R |
| 4,555,445 | 11/1985 | Frey et al. | 428/340 |

*Primary Examiner*—Stephen J. Lechert, Jr.
*Attorney, Agent, or Firm*—John J. Freer

[57] ABSTRACT

A porous, sintered powdered metal article having excellent corrosion resistance is provided. A porous metal such as prepared from a sintered iron powder and suitable for further treatment is phosphatized with a solvent phosphatizing composition. The phosphatized metal is then coated with a chromium-containing coating composition. The thus treated powdered metal part may be further topcoated and, in either case, exhibits outstanding corrosion resistance.

19 Claims, No Drawings

SINTERED, CORROSION-RESISTANT POWDERED METAL PRODUCT AND ITS MANUFACTURE

BACKGROUND OF THE INVENTION

It has been typical in the processing of powdered metal parts which have been prepared from materials such as atomized powdered metals which are then sintered, to also subject the hardened parts to plating. The plating, such as a zinc electroplating, can add to the corrosion resistance of the finished part. Resin impregnation may also be useful.

Some resin impregnation might even precede plating. Thus it has been disclosed in U.S. Pat. No. 3,007,822 to resin impregnate a hardened powdered metal part and then carbonize the resin followed subsequently by a carbo-nitriding process. In this manner enhanced substrate for plating can be prepared.

Resin impregnation can also be used in conjunction with oil-impregnation. Thus for example U.S. Pat. No. 4,014,802 discusses sintered parts having both an oil-impregnated portion as well as a resin-impregnated layer. The useful resin can be a thermosetting resin. Or the resin material might be useful for lubricating property.

It has been disclosed in U.S. Pat. No. 4,000,982 that it is well known for a porous sintered layer of iron or copper powder, which might be used in a bearing to be coated with a polytetrafluoroethylene resin. Within the specific teachings of the patent, there is taught the improvement of using such a resin as a dispersion, with the dispersion containing powdered zinc and aluminum oxide. An article of excellent wear-resistance is thereby prepared.

It would still nevertheless be desirable to treat porous, sintered metals in an economical manner and yet efficiently achieve a part of outstanding corrosion resistance.

SUMMARY OF THE INVENTION

There is now disclosed a sintered, porous metal part of excellent corrosion resistance. The treated part can be obtained in an economical manner which can obviate the need for plating. Furthermore the finished article can be made in such a manner that permits avoidance of resin impregnation. Treated parts in accordance with the present invention can exhibit desirable characteristics of sintered metal products while further demonstrating enchanced corrosion resistance.

The present invention in a broad aspect is directed to a sintered powdered metal in coated form, the coating being an undercoat/topcoat composite. The undercoat on the sintered powdered metal is a phosphatized coating from solvent phosphatizing composition. The topcoating on phosphatized metal is a cured residue from a chromium-containing coating composition.

In another important aspect the invention is directed to the foregoing described sintered powdered metal in coated form that is further overcoated with a composition containing silica substance in liquid medium. Another important aspect of the invention is directed to the method of preparing such sintered powdered metal in coated form.

DESCRIPTION OF THE PREFERRED EMBODIMENTS

The porous, sintered powdered metal parts as will generally be considered for use in the present invention include those parts prepared from powders such as atomized powders and including pre-alloyed powders. Most always the parts will be iron-based parts which can include alloys of iron as well as intermetallic mixtures. Thus in addition to iron parts, the useful materials can include the alloys of iron containing carbon and/or additional metals. These metals might be, for example, chromium, tungsten, nickel or cobalt. Additionally, parts wherein iron is doped with copper can be useful and thus in this sense copper alloys as well as other metals, which other metals may also be in alloy form and are contemplated to include zinc and aluminum, may also find use in the present invention.

Usually the porous metal part for processing will be directly introduced to the method of the present invention. However, some pretreatment operation may be useful. Such pretreatment operation can include heating, e.g., heating in addition to the sintering operation for preparing the metal part, but generally at a temperature not of the significantly elevated sintering temperature, such as at a temperature within the range of from about 500° to about 700° F. Additional pretreatment techniques include cleaning procedure such as dry honing or etching or pickling operation as well as alkaline cleaning and combination treatments, e.g., a washing or rinsing action combined with mild abrasive treatment It is critical that the porous sintered part, whether or not pretreated, proceed to solvent phosphatizing operation. Such operation subjects the metallic part to a liquid solvent phosphatizing composition providing a phosphatized coating of substantial water insolubility on the metal part. The phosphatizing compositions useful for providing the phosphate coating contain organic solvents which can include halogenated hydrocarbon. Such useful solvents may be chloroform, chlorobenzene, perchlorethylene, trichlorethylene, 1,1,1-trichlorethane, trichlorofloromethane, trichlorotrifluoroethane, methylene chloride and mixtures, such as halogenated hydrocarbon mixtures, e.g., an azeotropic mixture of trichlorotrifluoroethane and methylene chloride. For economy of operation, as well as efficient phosphatizing operation, it is preferred that the liquid solvent phosphatizing composition contain methylene chloride. Such a preferred methylene chloride phosphatizing composition has been shown for example U.S. Pat. No. 4,008,101, wherein it is also shown that a complex phosphatized coating of the iron phosphate type can be expected to be achieved on an iron-containing substrate.

As more fully disclosed in such patent, which disclosure is herein incorporated by reference, the phosphatizing solution will contain a solvent. This solvent is typically an alcohol such as methanol or ethanol, and assists in solubilizing of a minor amount of water in the phosphatizing solution, although the water may be present in the composition up to saturation. The phosphatizing composition may also further contain an aprotic organic compound such as N,N-dimethyl formamide as well as an organic accelerator compound such as dinitrotoluene. It is critical that the composition also include a phosphatizing agent, e.g., a commercially available phophoric acid. Phosphatizing compositions yielding non-water soluble coatings for utilization in the present invention have also been disclosed in U.S. Pat. Nos. 4,029,523, 4,447,273 and European Patent Application No. 34842.

It will be suitable to apply the phosphate coating from such liquid solvent phosphatizing composition to the powdered metal substrate by any means typically employed for obtaining the resulting phosphate coating on the metal substrate. Many such suitable operations have been discussed in the patents mentioned hereinbefore. General application techniques include dipping techniques where the porous metal part is first held in a heated vapor zone above boiling solvent phosphatizing composition, then dipped into the hot composition for a sufficient period of time to effect phosphatizing operation. Thereafter the part is removed from the composition and retained again in the hot vapor zone, which will then lead to the removal of an ostensibly dry part from the phosphatizing operation. In addition to such dipping techniques, spray operation is also serviceable, while combination operations, such as spray and dipping procedures, may be utilized.

The resulting phosphatized coating will typically be present, as on a sintered ferrous metal, in an amount above about 20 milligrams per square foot of coated metal, from such operations. Such coating weights as used herein are based upon the area of the porous metal that may be coated, and not upon the area of the face only of the metal. For example, a square foot face of porous metal, owing to the porosity, will supply a greater coated metal surface than just the square foot. Usually the phosphate coating will be present in an amount within the range of from about 30 to about 120 milligrams per square foot of coated metal, although greater weights, e.g., 150–200 milligrams per squre foot of coated metal are contemplated.

The resulting powdered metal part with phosphate coating from solvent phosphatizing composition will then usually proceed directly to topcoating operation. The known topcoating compositions for application over the phosphate coating need not be complex. Such topcoating compositions may form highly adherent coatings on the phosphate layer. Useful topcoat compositions are susceptible to curing at elevated temperature. Some of the very simple topcoating compositions, such as have been taught in U.S. Pat. No. 3,687,738, can have a hexavalent-chromium-containing substituent which may merely contain chromic acid, and also contain a particulate metal such as aluminum, manganese, zinc and magnesium or their alloys, in flake or powder or similar form, and which metals may be present in mixtures, as well as be present in mixed forms. Further, these particulate metals have been disclosed as useful in bonding coating compositions, containing a hexavalent-chromium-providing substance and reducing agent therefor, such as the disclosure in U.S. Pat. No. 3,671,331, which disclosure is herein incorporated by reference.

Also of particular interest in the present invention are the bonding coatings, i.e., coatings from compositions containing hexavalent-chromium-providing substance and a reducing agent therefor. Those that are preferred may contain succinic acid and other dicarboxylic acids of up to 14 carbon atoms as the reducing agents, as has been disclosed in U.S. Pat. No. 3,382,081. Other substances, such as a boric acid component, which can be totally supplied simply by boric acid, may also be present.

Substantially all of the topcoating compositions are simply water based, for economy. But for additional or alternative substances to supply the liquid medium, at least for some of these compositions, there have been taught, as in U.S. Pat. No. 3,437,531, blends of chlorinated hydrocarbons and a tertiary alcohol including tertiary butyl alcohol as well as alcohols other than tertiary butyl alcohol. In the selection of the liquid medium, economy will generally be of major importance, and thus such medium will most always contain readily commercially available liquids.

Particularly preferred topcoat compositions, for enhanced coating adhesion as well as corrosion resistance, will contain thickeners, such as water soluble cellulose ethers and will also contain 5–50 volume percent of high boiling organic liquid. For economy, these particular coating compositions preferably contain between about 0.01–3 weight percent of water soluble cellulose ether, such as hydroxethylcellulose and methylcellulose. Particularly preferred topcoat compositions contain organic liquid having a boiling point at atmospheric pressure above 100° C., while furthermore being water soluble. Particular hydrocarbons which may serve as the organic liquid include tri-, and tetraethylene glycol as well as di- and tripropylene glycol. Representative preferred topcoating compositions have been disclosed in U.S. Pat. No. 3,907,608.

The topcoating weight on the phosphatized powdered metal substrate may vary to a considerable degree but, exclusive of the particulate metal, will most typically always be present in each topcoating layer in an amount supplying above about 10 milligrams, and preferably above about 20 milligrams, per square foot of chromium, expressed as chromium and not $CrO_3$. For extended corrosion resistance, each layer may contain up to about 500 milligrams per square foot of chromium. Generally, if the coating contains particulate metal, the coating should have a weight of particulate metal of from above 10 to not substantially above about 8,000 milligrams per square foot of pulverulent metal for each topcoating layer.

Other compounds may be present in the topcoating composition, but often they will not contain resin, or only contain a minor amount of resin. Many will be substantially resin free. Those containing a minor amount of resin will most always contain less than about 5 weight percent resin, basis total composition weight. To be substantially resin free, the topcoating composition should contain less than about 20 grams per liter of resin.

After each topcoating application, it is preferred for best corrosion resistance to subsequently heat the applied coating. The preferred temperature for the subsequent heating, which is also often referred to as curing and which may be preceded by drying such as air drying, is within the range from about 350° F. at a pressure of 760 mm Hg up to not essentially above about 1000° F. Preheating the substrate prior to application of the liquid composition, such as retaining the substrate hot from phosphate coation operation, will assist in achieving cure temperature. However, such curing temperatures do not often exceed a temperature within the range of about 450°–700° F. At the elevated curing temperatures, the heating can be carried out in as rapidly as about a few seconds, but curing is often conducted for several minutes at a reduced temperature.

The resulting powdered metal part with the coating composite of phosphate undercoat with subsequent topcoat, may then be further coated, as with an overcoat containing silicate substance. The "silicate substance", as the term is used herein, can be organic or water soluble, inorganic silicates, as well as colloidal silicas. The organic silicates that can be, or have been useful include, e.g., ethyl, propyl, butyl and polyethyl silicates, as well as alkoxyl silicates such as ethylene glycol monoethyl silicate, tetra isobutyl silicate and tetra isopropyl silicate and further including aryl silicates such as phenyl silicates. Most generally for economy, the organic silicate is ethyl silicate. The silicates advantageously used in the present invention are the water soluble, inorganic silicates including sodium, potassium, lithium, sodium/lithium combinations, other related combinations, and ammonium including quaternary ammonium, as well as mixtures of the foregoing. With the alkali metal silicates, and referring to sodium silicate as exemplary, the mole ratios of $SiO_2$ to $Na_2O$ will generally be within the range from 1:1 to about 4:1 with the preferred ratio of $SiO_2$:$Na_2O$ being within the range from about 2:1 to 3.8:1. For economy, an aqueous based sodium silicate is used for the preferred embodiment. Such preferred silicate can typically have a pH on the order of about 12 or so. Representative overcoating compositions have been disclosed in U.S. Pat. No. 4,365,003.

Since such silicates are typically available as water solutions, the term "silicate substance" is used herein also for the convenience of denoting such combinations. Thus, the "silicate substance" as the term is used herein can impart both silicate and liquid medium to the overcoating composition. Although the use of solid silicates in the preparation of the overcoating composition is contemplated, the silicate substance will most always be a liquid medium containing from at least 0.5 weight percent solids, and may contain up to about 50 weight percent solids or more.

The overcoating composition and especially those described hereinabove, may also contain additional ingredients such as resins that may be supplied by a copolymer component. The copolymer used is most suitably a polyethylene-containing copolymer and the copolymer component can contribute from about 0.25 to about 25 weight percent of copolymer solids, basis total composition weight, to the overcoating composition. Representative copolymers for contributing to the copolymer component include ethylene acrylic acid copolymers and ethylene vinyl acetate copolymers. The overcoating composition may also contain a wax component, e.g., a microwax. Suitable waxes for the wax component are naturally occurring waxes such as paraffin waxes extracted from lignite or peat. Other waxes are the synthetic waxes obtained principally from mineral source raw materials, e.g., low molecular weight polymers of ethylene.

The overcoating compositions as discussed above can also contain coloring agent, including liquid and/or solid such agents. Suitable such agents that are cure-stable, as well as, leach resistant include the particulate pigments, e.g., titanium dioxide and calcium carbonate and including dyes, such as azo dyes. The overcoating composition may also include a surface active agent, or "wetting" agent, and may also include a defoaming agent as a formulation aid. As mentioned hereinabove, the overcoating composition medium will most typically be an aqueous medium, that can be supplied by an aqueous wax component and aqueous silicate substance. However, solvent systems, e.g., low molecular weight alcohols such as ethanol and isopropanol, as well as others including ethylene glycol monoethyl ether and mixtures containing xylene, toluene and the like, can also be employed. The useful compositions for this type of overcoating have been disclosed in U.S. Pat. No. 4,555,445.

The overcoat compositions as hereinabove discussed are capable of air drying at room temperature to a tack-free condition, but must be cured for providing a water-resistant and corrosion-resistant topcoating. Curing can be achieved by baking, e.g., at elevated temperatures. It is typical to select the curing conditions in accordance with the particular silicate substance used. For example, lower cure temperatures on the order of about 150° F. to about 300° F. will be useful for the colloidal silicas and organic silicates. For the inorganic silicates, curing typically takes place at a temperature on the order of about 300° F. to about 500° F. Thus, in general, cure temperatures on the order of from about 150° F. to about 500° F. are useful. Cure temperatures reaching above about 500° F. are uneconomical and undesirable. For best coating performance, the overcoat of the present invention is typically cured at temperatures within the range from about 200° F. to about 500° F. and preferably at a temperature from about 300° F. to about 450° F.

These overcoatings of the foregoing description may be applied by various techniques including brush, roller, conventional or electrostatic spray coating techniques, as well as the preferred immersion techniques including "dip drain" and "dip spin" operations. Dip drain is accomplished by simply immersing the substrate into the coating composition and letting the excess drain off after removal of the coated part. Dip spin is achieved by placing the parts to be coated in a basket and dipping same into the coating. The excess coating is removed by rapidly rotating the coated parts maintained in the basket. Articles can be overcoated that are at elevated temperature, as from curing of the preferred topcoating, by a procedure such as dip spin, dip drain or spray coat. By such operation, some to all of the topcoat curing is achieved without further heating.

Each of the hereinabove discussed overcoat layers should be present in an amount above about 50 milligrams per square foot of coated substrate. For economy, overcoat weights for each cured overcoating layer will not exceed about 5,000 milligrams per square foot of coated substrate. Preferably, for best efficiency and economy, the overcoat is present in the range of from about 200 to about 3,000 milligrams per square foot of coated substrate.

It is also contemplated that the powdered metal article with the composite of phosphate undercoat with subsequent topcoat can be overcoated with any suitable coating composition. These can include paints and the like, e.g., a paint, primer, enamel, varnish or lacquer or the like.

The following examples will serve to further illustrate the operation and advantages of the present invention. The examples should not be considered, however, as a limitation upon the scope of the present invention.

EXAMPLE 1

Sponge iron powdered metal test pieces are used. The pieces are approximately $1.3 \times 1.3 \times 3.9$ millimeters (mm.), the length including a slightly bulbous end containing an 0.7 mm. diameter aperture. The aperture and adjoining face each contain a shallow 0.5 mm. deep recess of about 1 mm. diameter at the aperture and 0.8×2 mm. dimension on the face. The test pieces have a density of 6.8 grams per cubic centimeter (g/cm$^3$). These parts metallurgically are 98.2 weight percent iron, 0.2 weight percent silicon and the balance principally carbon, sulfur and phosphorous. Upon visual inspection before testing or pretreatment, all parts can be seen to be free from rust or any contamination visible to the unaided eye.

Many of the test parts are employed in the test procedure without pretreatment. Mainly they are used as controls and are taken on an "as is" basis and proceed directly to coating operation. They are shown in the table below as containing no undercoat. Other test parts are pre-baked, as a pretreatment, in a convection oven at an oven air temperature within the range of 608° F. to 680° F. for one hour to volatilize any fugitive surface contamination that may be present. Some of the pre-baked control samples are then further pretreated by dry honing. For the dry honing, parts are placed in a basket tumbler and blasted with 60 mesh silica bead media for 10 minutes.

Some "as is" control parts, the pre-baked control parts, and the pre-baked and honed control parts are then sealed with a chromate sealer (rinse) containing partially reduced chromic acid. The sealer is applied by dipping the part in the sealer for a few seconds, removing the part and permitting excess sealer to drain from the part, followed by air drying at room temperature. All these thusly sealed parts are shown in the table below to have a "chromate" undercoat.

All of the foregoing test pieces (all being "control" test pieces) then proceed to a coating operation. This operation uses a composition referred to hereinafter as the "coating composition", which is shown in the table below as a "topcoat" and is prepared as follows: To 55 milliliters (mls.) of dipropylene glycol there is blended with moderate agitation 1.0 ml. of a nonionic wetter having a viscosity in centipoises at 25° C. at 280 and a density at 25° C. of 10 pounds per gallon, and 1 gram (gm.) of hydroxypropyl methyl cellulose thickener. The thickener is a very finely-divided cream to white colored powder. To this thickener mixture there is then added 84 gms. of flaked zinc (providing 75.5 gms. zinc and 8.5 gms. aluminum) using agitation during the addition. The zinc flake has particle thickness of about 0.1–0.5 micron and a longest dimension of discrete particles of about 80 microns. Separately there is added to 88 mls. of deionized water 12.5 gms. of $CrO_3$ and to this there is added an additional 88 mls. deionized water. To this chromic acid solution is added about 3 gms. of zinc oxide. The resulting chromic acid solution is slowly added to the metal flake dispersion to form the coating composition.

Two coats of the coating composition are applied to all test pieces as noted using the following procedure. For the application of each coat, parts ready for coating are coated by dipping into coating composition, then removing the part and draining excess composition therefrom, sometimes with a mild shaking action. The parts are then immediately dried for 10 minutes in a convection oven having a 200° F. oven air temperature, followed immediately by baking in the oven for 15 minutes at a 608° F. oven air temperature. The parts are then cooled to room temperature and proceed again through this coating application.

The parts treated in accordance with the present invention are taken "as is" without pretreatment and proceed directly to a solvent phosphatizing. The phosphatizing composition employed is the commercially available composition sold under the trade name "COOL-PHOS ®". Compositions of this type are known to be based upon methylene chloride and contain phosphoric acid and alcoholic solubilizing solvent as well as additional constituents, and have been described for example in U.S. Pat. No. 4,008,101. These parts representative of the present invention are prepared for coating by immersion in the phosphatizing bath maintained at boiling condition, for an immersion time of 30 seconds, followed by removal from the bath and residence in the hot vapor zone above the bath for 30 seconds. Parts thus treated are permitted to cool to room temperature.

Like the hereinbefore described control parts, these test pieces treated in accordance with the present invention are then topcoated with the above-described coating composition in the manner described hereinbefore.

All above described parts, i.e., control as well as present invention parts, are then overcoated. The overcoating employed is a commercially available sodium silicate having 21.7 weight percent solids in a water medium and a ratio of $SiO_2/Na_2O$ of 3.22. The topcoated parts for overcoating are dip coated in the manner of the topcoating and are baked in a convection oven at an oven air temperature of 350° F. for 10 minutes. This provides a total coating thickness on the parts of the present invention of approximately 0.2 mil, such that they are comparable in coating thickness to commercially available pieces used as a portion of the controls and described below.

The last test pieces used as controls in the test are commercially available parts of the same shape and metallurgy as above described. These have been prepared by commercially acceptable practices to achieve desirable corrosion resistance coupled with acceptable coating adhesion and thereby all parts are ready for commercial use. These commercial control test pieces are known to be resin impregnated with polyester resin and are then zinc plated. This treatment provides the test pieces with an approximately 0.2 mil thick coating. They are referred to in the table below as commercial parts.

All parts, including all hereinbefore discussed control pieces, are then subjected to corrosion resistance testing. The corrosion resistance of all such coated parts is measured by means of the standard salt spray (fog) test for paints and varnishes ASTM B-117. In this test, the parts are placed in a chamber kept at constant temperature where they are exposed to a fine spray (fog) of a 5 percent salt solution for specified periods of time, rinsed in water and dried. The extent of corrosion on the test parts is determined by comparing parts one with the other, and all by visual inspection. Results of such testing are shown in the table below.

TABLE 1

| Test Part | Pretreatment | Undercoat/ Topcoat** | Salt Spray: Range of Corrosion, 120 Hours |
|---|---|---|---|
| Control* | No | None/ Coating Composition | 0 to 20% |
| Control | No | Chromate/ Coating Composition | Trace to 20% |
| Control | Pre-Bake | Chromate/ Coating Composition | Trace to 25% |
| Control | Pre-Bake/ | Chromate/ | 0 to 5% |

TABLE 1-continued

| Test Part | Pretreatment | Undercoat/ Topcoat** | Salt Spray: Range of Corrosion, 120 Hours |
|---|---|---|---|
| | Hone | Coating Composition | |
| Control | Commercial Part*** | Resin/Zinc Plate | 10–40% |
| Invention | No | Solvent Phosphatize/Coating Composition | 0 to Trace |

*Twenty test pieces. All other data from 10 pieces per test part excepting 7 pieces for the invention test.
**All test pieces additionally are overcoated excepting the commercial parts.
***Pretreatment, if any, not known.

EXAMPLE 2

Additional sponge iron test parts as described in Example 1 are selected for testing. The parts used for control purposes are the commercially acceptable parts which have been polyester resin impregnated and then zinc plated.

The parts for the present invention are phosphatized and topcoated with the coating composition and procedures as described in Example 1. Also, the parts are overcoated with the composition and procedure of Example 1. All test pieces are then tested in the manner of Example 1, with pieces being removed from the test for visual inspection and corrosion rating, at the time intervals as shown in the table below. After rating, pieces are returned for testing. Results of such testing are shown in the table below.

TABLE 2

| Test Parts | Salt Spray: Range of Corrosion | | |
|---|---|---|---|
| | 24 Hours | 31 Hours | 96 Hours |
| Control* | 0 to 20% | 0 to 30% | 10 to 50% |
| Invention | 0% | 0% | 0% |

*Eleven parts each for the control as well as for the invention variations.

EXAMPLE 3

Iron test parts from atomized powdered metal and employed in this test are $1.3\times1.3\times3.2$ mm. dimension test pieces having a density of 6.35 g/cm$^3$. The metallurgy of these parts is 99.3 weight percent iron and a balance principally carbon, sulfur and silicon. The parts representative of the present invention are phosphatized with the COOL-PHOS solvent phosphatizing and topcoated with the coating composition of Example 1 using the procedures employed in Example 1. Similarly, these parts are overcoated using the composition and procedure of Example 1.

Parts used for control purposes are parts which have a commercially acceptable coating combination obtained by processing the parts through polyester resin impregnation and then zinc plating. In such preparation, these parts have also been finished with a chromate sealer.

All test pieces are then tested in the manner of Example 1 and are rated in the manner of Example 1. Results of such testing are shown in the table below. Parts removed from the test for rating are not reintroduced to the test for further testing.

TABLE 3

| Test Parts | Salt Spray: Range of Corrosion | | | |
|---|---|---|---|---|
| | 48 Hours | 120 Hours | 216 Hours | 408 Hours |
| Control | Tr–3% | 10–20% | 25–85% | 90–100% |

TABLE 3-continued

| Test Parts | Salt Spray: Range of Corrosion | | | |
|---|---|---|---|---|
| | 48 Hours | 120 Hours | 216 Hours | 408 Hours |
| Invention | 0–Tr | 0–<1% | 0–Tr | 0–Tr |

Tr = Trace.

What is claimed is:

1. A sintered powdered metal in coated form, the coating being an undercoat/topcoat composite, the undercoat on the sintered powdered metal being a phosphatized coating from solvent phosphatizing composition and the topcoating over the phosphatized sintered powdered metal being a cured residue from a chromium-containing coating composition.

2. The sintered powdered metal of claim 1 wherein the metal to be coated is from iron-containing powder in said sintered form.

3. The sintered powdered metal of claim 2 wherein the metal is undercoated with a complex phosphatized coating of the iron phosphate type.

4. The sintered powdered metal of claim 1 wherein the metal to be coated is from copper-containing powder in sintered form.

5. The sintered powdered metal of claim 1 wherein the metal to be coated is from zinc- or aluminum-containing powder in sintered form.

6. The sintered powdered metal of claim 1 wherein said phosphatized coating is present on the sintered metal in an amount from about 20 to about 120 milligrams per square foot of coated sintered metal.

7. The sintered powdered metal of claim 1 wherein said undercoat is obtained by contacting the metal with a water-containing, liquid solvent phosphatizing composition containing methylene chloride, trichlorotrifluoroethane or an azeotropic mixture thereof.

8. The sintered powdered metal of claim 1 wherein said topcoating cured residue contains chromium in each applied layer of the topcoating in an amount within the range of from about 10 to about 500 milligrams per square foot of coated sintered metal.

9. The sintered powdered metal of claim 1 wherein said topcoating cured residue contains particulate metal and the particulate metal in each applied layer of the topcoating is present in an amount within the range of from above 10 but not substantially above about 8,000 milligrams per square foot of coated sintered metal.

10. The sintered powdered metal of claim 1 wherein said undercoat/topcoat composite is further coated with an overcoating composition.

11. The sintered powdered metal of claim 10 wherein said overcoating composition contains silicate substance in liquid medium providing above about 50 milligrams per square foot of coated metal of silicate substance in each cured overcoating layer.

12. The method of preparing a corrosion resistant sintered powdered metal in coated form, which method comprises phosphatizing the sintered powdered metal with solvent phosphatizing composition providing a phosphatized undercoating on the powdered metal, applying on the resulting phosphatized undercoating a heat-curable chromium-containing topcoating, and curing applied topcoating.

13. The method of claim 12 wherein said sintered powdered metal is cleaned and degreased before undercoating.

14. The method of claim 12 wherein the phosphatizing of the sintered powdered metal includes withdrawing said metal from contact with liquid solvent phosphatizing composition followed by evaporating volatile constituents from the resulting phosphatized metal.

15. The method of claim 12 wherein said topcoating is heat cured at a temperature within the range of from about 200° F. to about 1000° F.

16. The method of claim 12 wherein said cured topcoating is further coated with an overcoating composition.

17. The method of claim 16 wherein said overcoating composition contains silicate substance in liquid medium providing above about 50 milligrams per square foot of coated substrate of silicate substance in each cured overcoating layer.

18. A corrosion resistant sintered powdered metal in coated form produced by the method of claim 12.

19. A corrosion resistant sintered powdered metal in coated form produced by the method of claim 16.

* * * * *